US005802810A

United States Patent [19]

Wojcik et al.

[11] Patent Number: 5,802,810

[45] Date of Patent: Sep. 8, 1998

[54] METHOD AND APPARATUS FOR WRAPPING AND SECURING STRETCH FILM ABOUT A LOAD

[75] Inventors: John P. Wojcik, Long Grove; Donald L. Van Erden, Wildwood, both of Ill.; Werner K. Diehl, Parkland, Fla.

[73] Assignee: Illinois Tool Works Inc., Glenview, Ill.

[21] Appl. No.: 896,315

[22] Filed: Jun. 28, 1997

[51] Int. Cl.[6] ..... B65B 13/00; B65B 53/00

[52] U.S. Cl. ..... 53/399; 53/441; 53/551; 53/588

[58] Field of Search ..... 53/399, 441, 556, 53/587, 588

[56] References Cited

U.S. PATENT DOCUMENTS

| | | | |
|---|---|---|---|
| 4,235,062 | 11/1980 | Lancaster et al. | 53/587 X |
| 4,619,102 | 10/1986 | Geising | 53/399 |
| 4,747,252 | 5/1988 | Kapke | 53/399 |
| 5,070,676 | 12/1991 | Laczkowski et al. . | |
| 5,077,956 | 1/1992 | Thimon . | |
| 5,088,270 | 2/1992 | Diehl . | |
| 5,168,691 | 12/1992 | Errani | 53/587 |
| 5,195,296 | 3/1993 | Matsumoto . | |
| 5,212,933 | 5/1993 | Cere . | |
| 5,452,566 | 9/1995 | Benhamou et al. . | |
| 5,463,843 | 11/1995 | Sharp . | |
| 5,473,861 | 12/1995 | Fukunaga et al. . | |
| 5,564,258 | 10/1996 | Jones et al. | 53/588 X |
| 5,689,934 | 11/1997 | Scherer et al. | 53/588 X |

FOREIGN PATENT DOCUMENTS

| | | | |
|---|---|---|---|
| 1081110 | 7/1980 | Canada | 53/588 |
| 289784 | 11/1988 | European Pat. Off. | 53/588 |

OTHER PUBLICATIONS

Tol–O–Matic Product Brochure, BC2 Series (BC220/BC225) Band Cylinders, 3 pages.

*Primary Examiner*—Linda Johnson
*Attorney, Agent, or Firm*—Donald J. Breh

[57] ABSTRACT

A method and apparatus for wrapping and securing film about a load by positioning a first arm retaining an end portion of film toward the load, wrapping a layer of film about the first arm so the first arm is between the wrapped film and the load, withdrawing the first arm retaining the film from between the wrapped film and the load, and releasing the end portion of film retained by the first arm to position and secure a first film portion between the wrapped film and the load. The load is further wrapped and a second arm is subsequently positioned toward the load, and a layer of film is wrapped about the second arm so the second arm is between the wrapped film and the load. A roped film portion is captured and retained by the first and second second arms. The roped film is then severed and an end portion of the severed film is retained by the first arm for subsequently wrapping another load. The other end of the severed roped film portion is retained by the second arm, which is withdrawn from between the wrapped film and the load to position and secure a second film portion between the wrapped film and the load. The arms are withdrawn along a relatively straight path by laterally translating the arms while pivoting thereby reducing contact between at least the portion of the arm retaining the film tail and the wrapped film.

20 Claims, 4 Drawing Sheets

74
67
70
80
137
136
138
134
132
72
73
a
b
92
61
66
65
60
62
63
220
210
200
124
122
114
68
69
82
94
64
93

METHOD AND APPARATUS FOR WRAPPING AND SECURING STRETCH FILM ABOUT A LOAD

BACKGROUND OF THE INVENTION

The invention relates generally to methods and apparatuses for wrapping and securing stretch film about a load, and more particularly to securing tail portions of stretch film about a load wrapped at a load wrapping station.

The wrapping of stretch film about articles or assemblages of packages, referred to herein as a load, is known generally and used widely. Spiral film wrapping systems for example include a rotary arm having an outer end with a downright member for supporting a vertically reciprocatable stretch film dispenser orbital about a stationary load positioned in a film wrapping station. The stretch film dispenser pays out film under tension as the dispenser orbits the load and reciprocates vertically along the downright thereby wrapping the film about the load. In other stretch film wrapping systems, the load rotates about a vertical axis or about a horizontal axis relative to a non-orbiting stretch film dispenser that correspondingly reciprocates either vertically or horizontally relative to the rotating load as film is dispensed therefrom and wrapped about the load. And in other film wrapping systems referred to as ring film wrapping machines, a film dispenser is orbited in a fixed plane about a horizontal axis and the load is moved along the axis relative to the orbiting dispenser, whereby film is wrapped spirally about the load.

Upon completion of the film wrapping operation, a clamp and sealing apparatus generally severs the film from the stretch film dispenser and secures a free end portion of the film, or film tail, to the wrapped load. A second film tail may be clamped and retained by the apparatus for subsequently wrapping film about another load. U.S. Pat. No. 5,088,270, entitled "Film-Tail Heat Sealing System" issued on 18 Feb. 1992 to Werner K. Diehl and assigned commonly herewith, for example, discusses a stationary heat sealing and clamping apparatus located some distance away from a film wrapping station for welding overlapping film layers stretched away from the wrapped load. The system also includes a film cutter and clamping member to retain an end portion of film for use in a subsequent film wrapping operation. The system utilizes the elastic nature of the stretch film to draw the welded overlapping film layers away from the heat sealing apparatus and back toward the surface of the wrapped load upon completion of the welding operation, and has many advantages over prior art stretch film welding systems including improved control over the application of heat to the overlapping film layers.

The present invention is drawn to novel methods and apparatuses for wrapping and securing film about a load without heated welding of overlapping stretch film layers.

It is thus an object of the invention to provide a novel method and system for wrapping film generally, and more particularly for securing tails of stretch film wrapped about a load, wherein the features, aspects and advantages of the invention are integrateable with existing rotary arm spiral film wrapping systems, vertical and horizontal rotating load wrapping systems, and ring film wrapping systems.

It is a more specific object of the invention to provide a novel method and apparatus for securing film tails wrapped about a load by positioning film tails between the wrapped film and the load, whereby the elasticity of the stretch film secures at least a portion of the film tail therebetween.

It is another object of the invention to provide a novel method and apparatus for wrapping and securing film tails about a load by positioning a first arm retaining an end portion of film toward the load, wrapping a layer of film about the first arm so the first arm is between the wrapped film and the load, withdrawing the first arm retaining the film from between the wrapped film and the load, and releasing the end portion of film retained by the first arm to position and secure a first film portion between the wrapped film and the load.

It is a further object of the invention to provide a novel method and apparatus for securing film tails wrapped about a load by positioning a second arm toward the load, wrapping a layer of film about the second arm so the second arm is between the wrapped film and the load, capturing and retaining a roped film portion with the second arm, withdrawing the second arm retaining the roped film portion from between the wrapped film and the load, and releasing the roped film portion retained by the second arm to position and secure a second film portion between the wrapped film and the load.

It is a more specific object of the invention to withdraw at least the first and second arm portions retaining film tails from between the wrapped film and the load along a relatively straight path to substantially reduce contact between the arms and the film, and in one embodiment to provide means for pivoting the arms while laterally shifting the arms for this purpose.

It is yet another object of the invention to provide a novel method and apparatus for wrapping and securing film about a load by capturing and retaining a roped film portion with a first arm positioned toward the load, severing the roped film portion, retaining an end portion of the severed film in the first arm, and releasing another end portion of the severed film, which is positioned and secured between the wrapped film and the load.

These and other objects, features, aspects and advantages of the present invention will become more fully apparent upon careful consideration of the following Detailed Description of the Invention and the accompanying Drawings, which may be disproportionate for ease of understanding, wherein like structure and steps are referenced by corresponding numerals and indicators.

BRIEF DESCRIPTION OF THE DRAWINGS

FIGS. 1*a*–1*m* illustrate sequential operation of a stretch film wrapping system for wrapping and securing film about a load at a load wrapping station according to an exemplary method of practicing the invention.

DETAILED DESCRIPTION OF THE INVENTION

Figure 1A:
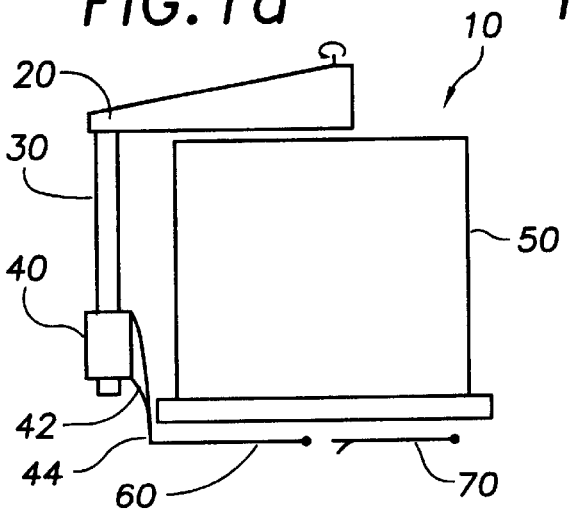

FIGS. 1*a*–1*m* illustrate sequential operation of a stretch film wrapping system for wrapping and securing film about a load at a load wrapping station, wherein the film wrapping system 10 includes an overhead rotary arm 20 with a downright member 30 reciprocatably supporting a film dispenser 40 that orbits a stationary load 50 and pays out film 42 as the arm 20 rotates overhead. One such film wrapping system is known in the trade as a Cobra™ spiral film wrapping machine, and is available from ITW Mima, an Illinois Tool Works Company, Tamarac, Fla. The rotary arm 20 of FIGS. 1*a*–1*m* is shown rotatable in the clockwise direction as viewed from above the load, but the rotary arm 20 may alternatively rotate counter-clockwise in this and other applications.

More generally, those of ordinary skill in the art will understand and appreciate that the objects, aspects, features and advantages of the invention are useful also with film wrapping systems other than spiral film wrapping machines, including systems that apply stretch film from a film dispenser that reciprocates vertically relative to a load rotating on a turn-table or otherwise about a vertical axis, or from a film dispenser that reciprocates horizontally relative to a load rotating on a spindle or otherwise about a horizontal axis, as well as with ring type film wrapping systems.

Figure 1B:
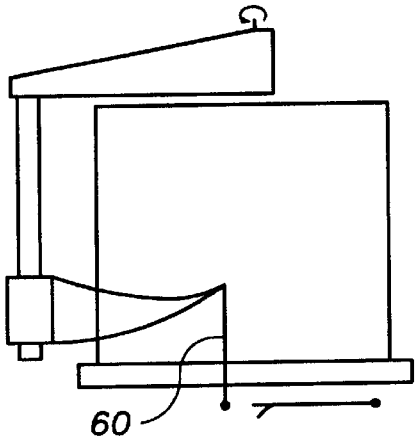
Figure 1C:
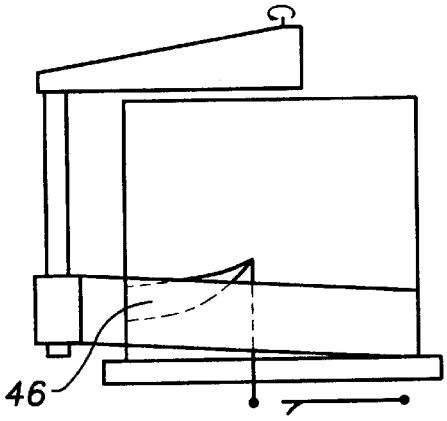

FIG. 1*a* shows the load 50 positioned in a film wrapping station, which is accessible typically by conveyor or similar means, wherein an end portion of film 44 is retained by a first clamping member of a first arm 60 in a position which does not interfere with the conveying, or positioning, of the load at the film wrapping station as discussed further below. The first arm 60 is positionable toward the load as shown in FIG. 1*b* by pivoting the first arm 60 to an upright position. In the exemplary embodiment, the first arm 60 is shown pivoting upwardly in a clockwise direction, but the first arm 60 may alternatively pivot upwardly in a counter-clockwise direction. FIG. 1*c* shows at least one layer of film wrapped about the first arm 60 positioned toward the load and the load so that at least a portion of the first arm 60 is between the wrapped film and the load.

Figure 1D:
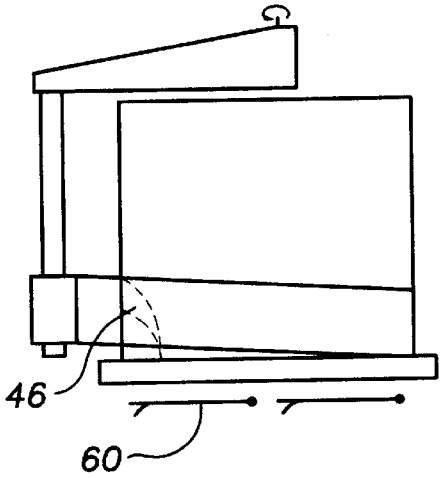

FIG. 1*d* shows the first arm 60 retaining the end portion of film withdrawn from between the wrapped film and the load, and the end portion of film retained by the first arm released whereby at least a first portion of film 46 is positioned and secured between the wrapped film and the load. In the exemplary illustration, the first arm 60 is pivoted downwardly and the first clamping member of the first arm 60 is actuated into an opened configuration to release the film after the first arm 60 is withdrawn from between the wrapped film and the load. The first arm 60, however, may more generally release the end portion of film before, or during, or after the first arm 60 is withdrawn from between the wrapped film and the load so long as at least a first portion of film is positioned and securable between the wrapped film and the load.

The resilient nature of the stretch film permits the wrapped film to stretch over the first arm 60 as shown in FIG. 1*c,* and permits the first arm 60 to be withdrawn from between the wrapped film and the load. The resilient nature of the stretch film also permits wrapped film to remain wrapped firmly about the load after the first arm 60 is withdrawn from between the wrapped film and the load thereby securing the first film portion 46 between wrapped film and the load.

Figure 1E:
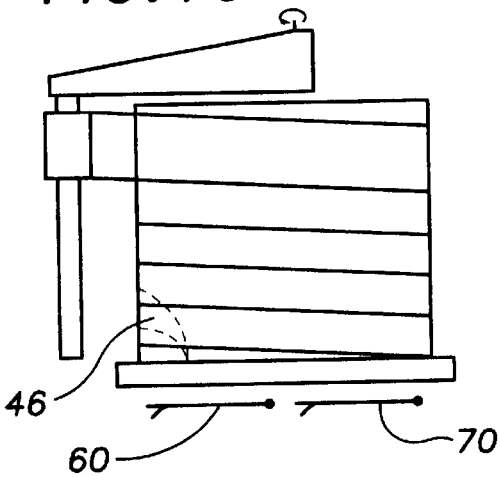
Figure 1F:
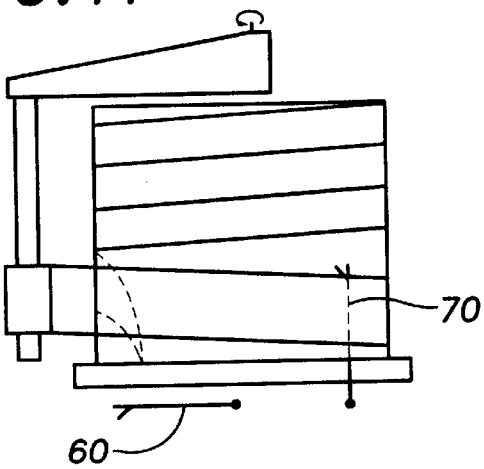
Figure 1G:
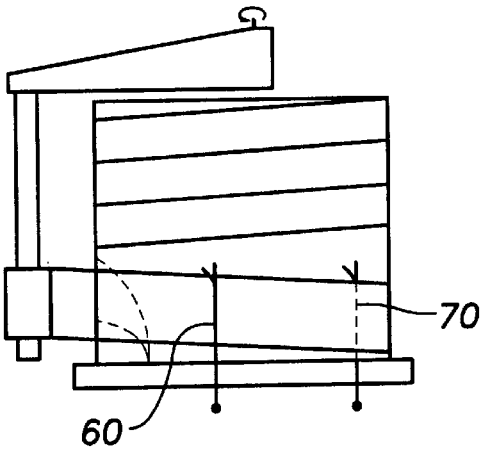

FIG. 1*e* illustrates film wrapped about the load after a portion of film 46 is positioned and secured between the wrapped film and the load, wherein the first arm 60 and a second arm 70 are positioned to prevent interference with the load wrapping operation. In the exemplary illustration, the first arm 60 and second arm 70 are pivoted downwardly from the upright position. FIG. 1*f* illustrates the second arm 70 positioned toward the load by pivoting the second arm 70 clockwise to an upright position. The second arm 70 may alternatively be pivoted upwardly in a counterclockwise direction. According to this aspect of the invention, at least one layer of film is wrapped about the second arm 70 positioned toward the load and the load so that at least a portion of the second arm 70 is between the wrapped film and the load. FIG. 1*g* shows the first arm 60 subsequently positioned toward the load, by pivoting uprightly, after the at least one layer of film is wrapped about the second arm 70 positioned toward the load, wherein the first arm 60 is positioned outside the layer of wrapped film.

Figure 1H:
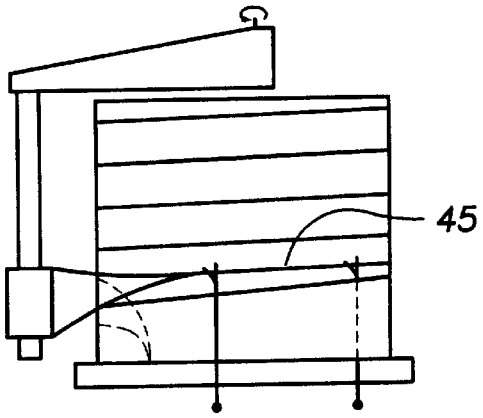
Figure 1J:
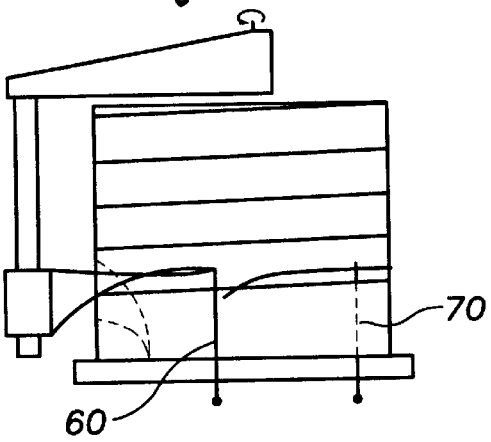

FIG. 1*h* shows a portion of film wrapped subsequently about the load formed into a rope 45, or roped, by means known in the art, and FIG. 1*g* shows the first clamping member of the first arm 60 and the second clamping member of the second arm 70 both previously actuated in an opened configuration for capturing and retaining the roped portion of the film as discussed below. The first and second clamping members may be actuated in the opened configuration before, or during or after the arms 60 and 70 are pivoted in the upright position. FIG. 1*h* also shows the roped film portion 45 being captured by the first and second clamping members of the first and second arms 60 and 70, as the roped film 45 is wrapped about the load. FIG. 1*j* shows the roped film portion 45 retained by the first and second clamping members of the first and second arms 60 and 70 actuated subsequently in a closed configuration. FIG. 1*j* also shows the roped film portion 45 being severed by one of the first and second clamping members of the first and second arms 60 and 70 as discussed below.

Figure 1K:
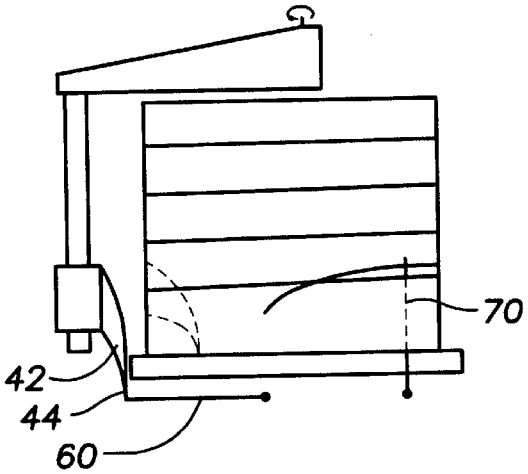
Figure 1L:
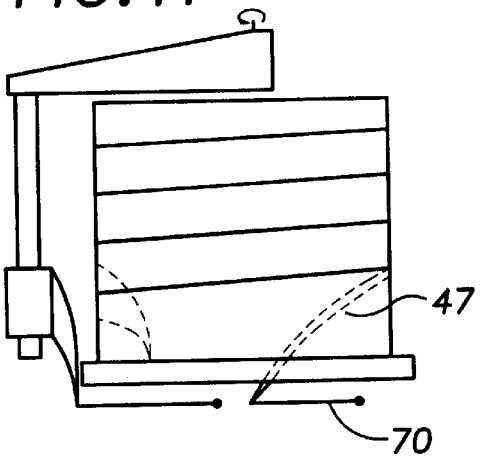
Figure 1M:
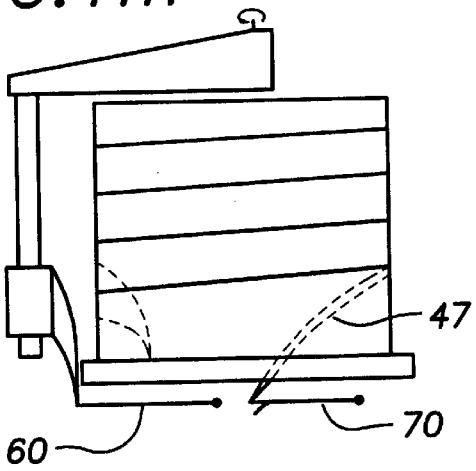

FIG. 1*k* shows the first arm 60 positioned away from the load by pivoting the arm 60 downwardly whereby the first arm 60 retains an end portion 44 of the film 42. In FIG. 1*i*, the second arm 70 retaining the film is withdrawn from between the wrapped film and the load, and the film retained by the second arm is released whereby a second portion of film 47 is positioned and secured between the wrapped film and the load. In the exemplary illustration of FIG. 1*m,* the second arm 70 is pivoted downwardly and the second clamping member of the second arm 70 is actuated in the opened configuration to release the film after the second arm 70 is withdrawn from between the wrapped film and the load. The second arm 70, however, may more generally release the film before, or during, or after the second arm 70 is withdrawn from between the wrapped film and the load so long as at least a second portion of film is positioned and securable between the wrapped film and the load. According to this aspect of the invention, the first and second end portions 46 and 47 of the wrapped film are secured between the wrapped film and the load. The first and second arms 60 and 70 remain positioned away from the load to prevent interference during the removal of the wrapped load from the film wrapping station and the subsequent positioning of an unwrapped load at the film wrapping station.

According to another aspect of the invention, at least a portion of the arms 60, 70 retaining the end portion of film is withdrawn from between the wrapped film and the load along a relatively straight path to reduce unnecessary contact between the arm and the film. One mode of practicing this aspect of the invention is by shifting the arm while downwardly pivoting the arm. Thus, as the first arm 60 is moved from the upright position in FIG. 1*c* to the downright position in FIG. 1*d,* the first arm also shifts laterally so that at least the first clamping member of the first arm retaining the end portion of film 44 is withdrawn from between the wrapped film and the load along a relatively straight path. Similarly, as the second arm 70 moves from the upright position in FIG. 1*k* to the downright position in FIG. 1*l*, the second arm also shifts so that at least the second clamping member of the second arm retaining the roped portion of film 44 is withdrawn from between the wrapped film and the load along a relatively straight path.

Shifting the arms while pivoting also facilitates controlling tension applied to the film tail 46 when withdrawing the arms. According to this aspect of the invention, each arm is shifted in a direction so that the film tail is not tensioned excessively or insufficiently when withdrawing the arm. Shifting of the arm thus prevents excessive film tensioning that may result in tearing of the film tail and premature release thereof from the arm, which may prevent proper positioning and securing of the film tail between the wrapped film and the load. Shifting of the arms also prevents insufficient film tensioning that may result in bunching of the film tail between the wrapped film and the load, which increases the possibility of entanglement between the arm and film during withdrawal.

Figure 2:
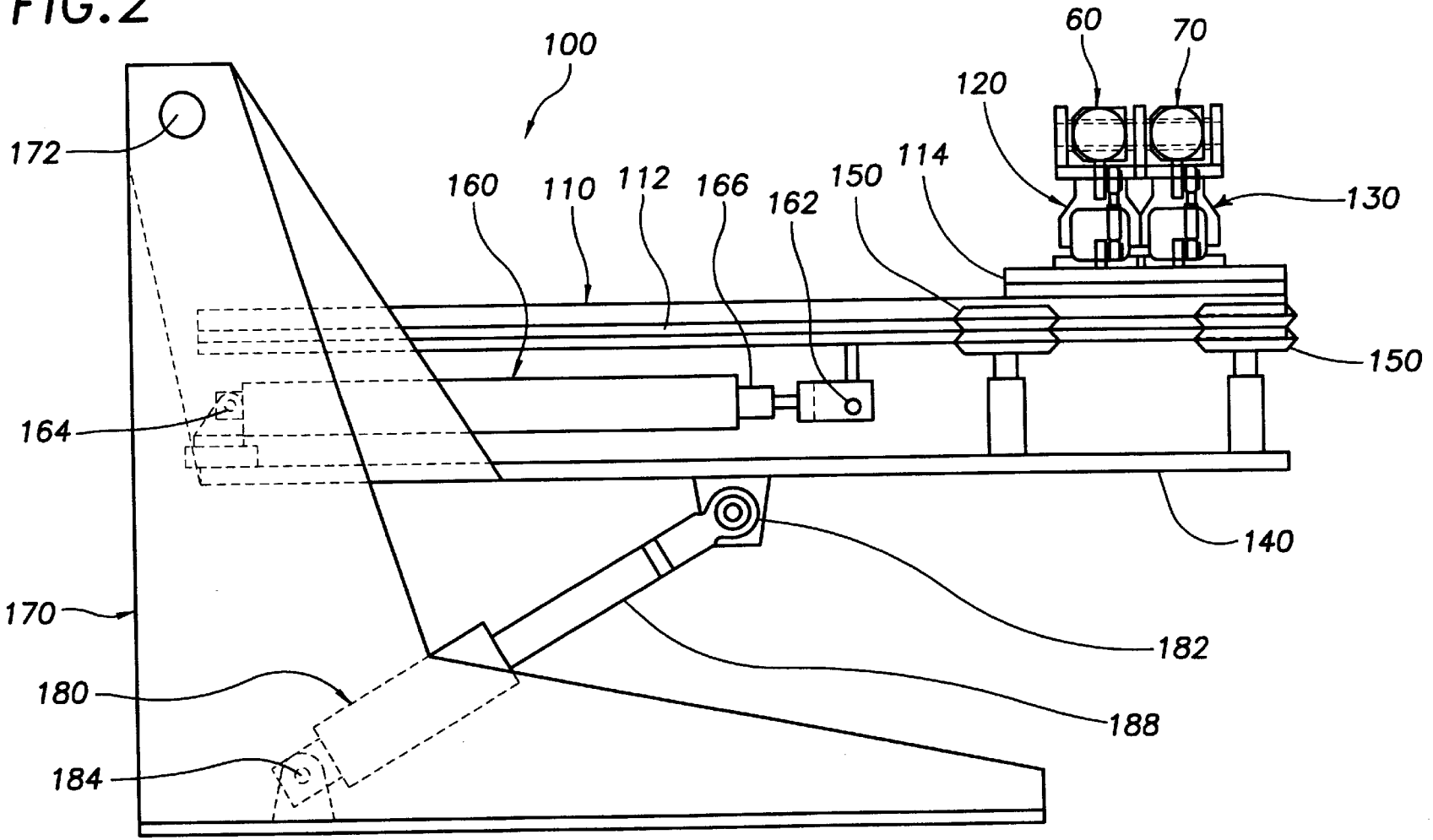
FIG. 2 is a side elevational view of an apparatus for forming and securing tails of film wrapped about a load.
Figures 3, 4A, 4B, 5:
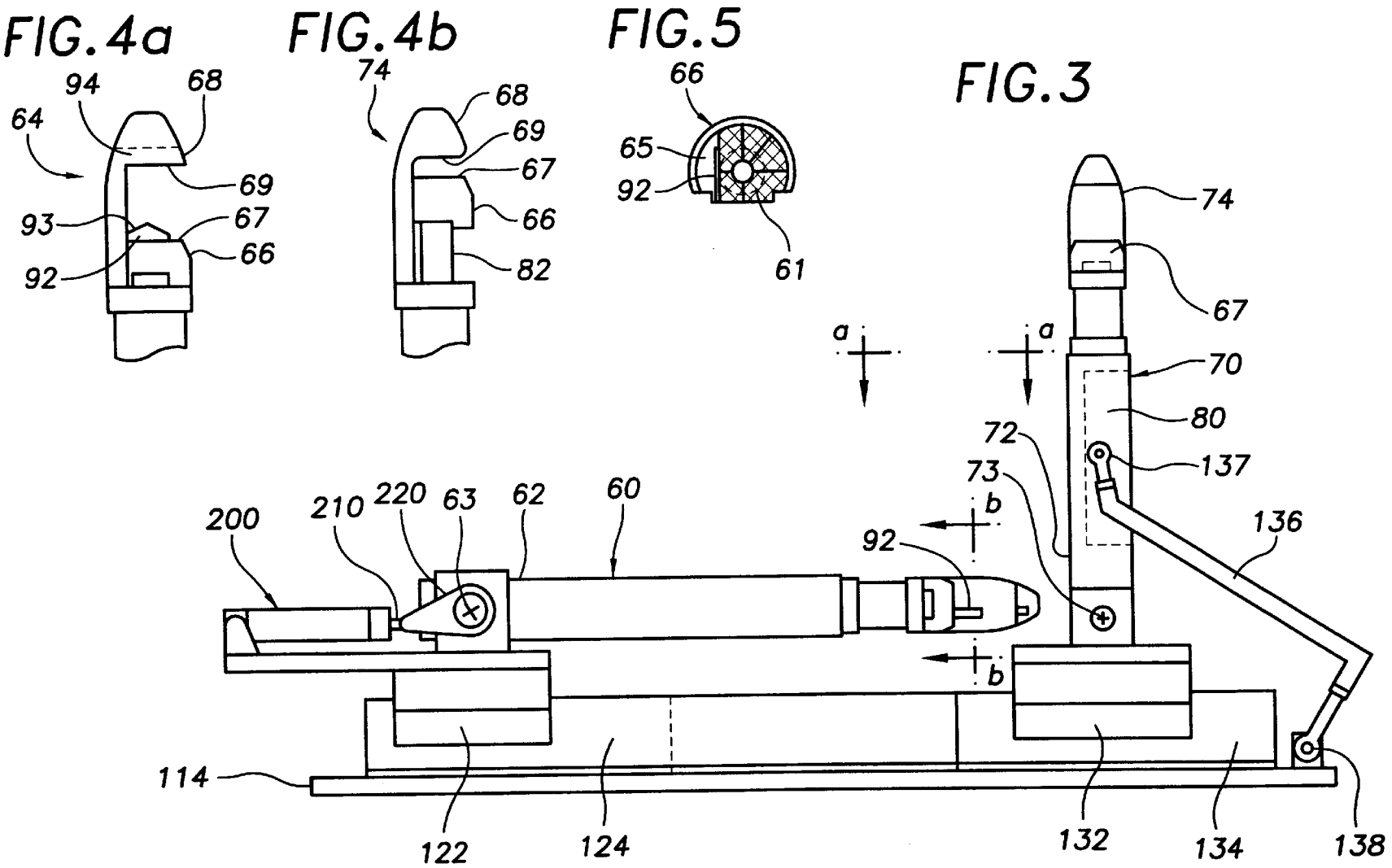
FIG. 3 is a partial end elevational view of the apparatus of FIG. 2 with one arm in an upright position as viewed toward the load.
FIG. 4*a* is a partial side elevational view of a first clamping member in an opened configuration along lines a—a of FIG. 3.
FIG. 4*b* is a partial side elevational view of a second clamping member on a second end portion of a second arm in a closing configuration.
FIG. 5 is partial top plan view along lines b—b of FIG. 3.

FIG. 2 is a side elevational view of an apparatus 100 useable for securing tails of stretch film wrapped about a load at a load wrapping station as discussed above. FIGS. 2 and 3 show the apparatus 100 including generally a first arm 60 pivotally coupled at a first base portion 62 to a base member 110, and a second arm 70 pivotally coupled at a second base portion 72 to the base member 110. FIG. 3 shows the first and second arms 60 and 70 pivotable about corresponding axes 63, 73 between a lowered position and an upright position relative to the base member 110. In the exemplary embodiment of FIGS. 2 and 3, each of the first and second arms 60 and 70 are pivotally coupled to the base member 110 by a corresponding pneumatically actuated rodless cylinder 120, 130 mounted on a platform 114 supported by the base member 110. Each cylinder includes generally a carriage 122, 132 translatably mounted on a corresponding cylinder portion 124, 134, wherein the carriage 122, 132 is actuatable pneumatically to move back and forth along the cylinder portion 124, 134. FIG. 3 shows the first and second base portions 62, 72 of the arms 60, 70 pivotally coupled to the carriage 122, 132 of the corresponding rodless cylinder. Rodless cylinders suitable for this application are available from Tol-O-matic Inc., Hamel, Minn., for example, Band Cylinders®, Model No. BC-220.

In the exemplary embodiment of FIG. 3, the base portion 62 of the first arm 60 is pivotally coupled to the translatable carriage 122, which includes an actuatable cylinder 200 mounted thereon. An extendable and retractable arm 210 of the cylinder 200 is coupled to the base portion 62 of the first arm by a lever 220, wherein the first arm 60 is pivotal upwardly upon extension of the arm 210, and the first arm is pivotal downwardly upon retraction of the arm 210. The lever 220 is shown on the side of the first arm 60 away from the load, but in other embodiments the lever 220 may be disposed on the other side of the first arm 60. In one configuration, the actuatable arm 210 is biased in the retracted position by a spring member disposed within the cylinder 200, not shown, wherein the first arm 60 is pivotal upwardly upon extending the rod 210 against the bias of the spring member within the cylinder 200. A cylinder suitable for this purpose is a pneumatically actuatable cylinder, which are widely available. Thus, the first arm 60 is pivotal upwardly upon application of pneumatic pressure to the cylinder 200, wherein the pneumatic pressure extends the actuatable arm 210 against the bias of the spring member. The first arm 60 is pivotal downwardly upon release or removal of the pneumatic pressure from the cylinder 200, wherein the actuatable arm 210 is retractable by the spring member. The second arm 70 may alternatively be configured identically to the first arm 60.

According to a related aspect of the invention, the carriage 122 is translatable along the rodless cylinder 124 during the upwardly and downwardly pivoting of the first arm 60. More particularly, as the first arm 60 is pivoted upwardly, the carriage 122 is translated along the cylinder 124 in the rightwardly direction in FIG. 3. Also, as the first arm 60 is pivoted downwardly the carriage 122 is translated along the cylinder 124, in the leftwardly direction in FIG. 3. This combined shifting and pivoting motion of the first arm 60 causes the upwardly and downwardly moving first arm 60 to move in a relatively straight path, particularly the clamping portion 64 of the first arm 60. The second arm 70 may be shifted and pivoted similarly.

In an alternative exemplary embodiment also shown in FIG. 3, the base portion 72 of the second arm 70 is pivotally coupled to the translatable carriage 132, and the second arm 70 is pivotally coupled to the base member 110 by a fixed link 136 having a first end portion 137 pivotally coupled to the second arm 70, and a second end portion 138 pivotally coupled to the platform 114. The link 136 is shown on the side of the second arm 70 away from the load, but in other embodiments the link 136 may be disposed on the other side of the arm. The second arm 70 is pivotal between an upright position and a lowered position upon actuation of the corresponding rodless cylinder 130, which moves the carriage 132 along the cylinder portion 134 in the leftwardly direction away from the link 136 to downwardly pivot the second arm 70 about its base portion 72. The second end portion 137 of the downwardly pivoting link 136 moves in an arcuate path permitting the carriage 132 and the base portion 72 of the arm 70 to shift laterally along the carriage 134 as the arm and link 136 are pivoted. The second arm 70 is pivotal between a downright position and an upright position upon actuation of the corresponding rodless cylinder 130, which moves the carriage 132 along the cylinder portion 134 in the rightwardly direction toward the link 136 to upwardly pivot the second arm 70 about its base portion 72. The second end portion 137 of the upwardly pivoting link 136 moves in an arcuate path permitting the carriage 132 and the base portion 72 of the arm 70 to shift laterally along the carriage 134 as the arm and link 136 are pivoted. This combined shifting and pivoting motion of the second arm 70 while pivoting upwardly and downwardly causes the arm to move in a relatively straight path, particularly the clamping portion of the second arm retaining the film tail. The first arm 60 may alternatively be configured identically to the second arm 70.

FIG. 3 shows the first arm 60 having a first clamping member 64 at a first end portion of the first arm 60, and the second arm 70 having a second clamping member 74 at a second end portion of the second arm 70. FIG. 4 shows the clamping members 64, 74 each having a first jaw member 66 with a first film engagement surface 67 and a second jaw member 68 with a second film engagement surface 69, at least one of which is movable relative to the other between an opened configuration and a closed configuration. The first jaw member 66 is movable relative to the second jaw member 68, wherein FIG. 4*a* shows the first jaw member 66 of the first clamping member 64 in the opening configuration, and FIG. 4*b* shows the first jaw member 66 of the second clamping member 74 in a closing configuration. According to this aspect of the invention, the film is generally capturable and retainable between a first surface 67 of the first jaw member 66 and the second surface 69 of the second jaw member 68 in the closed or closing configuration.

FIG. 3 shows an actuatable cylinder 80 disposed within the arm 70, and FIG. 4*b* shows the first jaw member 66 of the second clamping member 74 coupled to a cylinder rod 82 that is extendable and retractable by the actuatable cylinder 80 to position the movable first jaw 66 between opened and closed configurations. The second arm 70 includes a corresponding actuatable cylinder, not shown, with an extendable and retractable cylinder rod for similarly positioning the corresponding movable first jaw 66 of the second clamping member 74. A cylinder suitable for this application is a pneumatically actuatable cylinder of the type available from Bimba™, Model No. FOS.

According to another aspect of the invention, at least one of the first and second clamping members 64 and 74 includes a film severing member between corresponding first and second jaw members 66 and 68 for severing film during the closing of the clamping member. In the exemplary embodiment, the first clamping member 64 includes a film severing blade 92 with a cutting edge 93 protruding from the first surface 67 of the movable first jaw member 66, as shown in FIGS. 3 and 4. The blade 92 is extendable into a complementary shaped cavity 94 formed in the second surface 69 of the second jaw member 68 to permit severing of roped film during closing of the jaw members 66 and 68, and to permit subsequent engagement of at least one of the resulting severed film tails. According to this aspect of the invention, the film severing member, or blade 92, severs roped film captured between the first surface 67 and the second surface 69, wherein one film tail is released from one side of the blade 92 and the other film tail is retained between the first surface 67 and the second surface 69 for a subsequent film wrapping operation.

FIG. 5 is a top plan view of the first surface 67 of the first jaw member 66 and illustrates a diamond knurled or other friction enhancing configuration 61 formed on the first surface 67 thereof to facilitate capturing and retaining the film during the closing and closed configuration. More generally, the either or both the first and second surfaces 67 and 69 of the first and second clamping members 64 and 74 may have such a film engagement enhancing configuration. FIG. 5 also shows the friction enhancing configuration 61 of the jaw member formed on only one side of the blade 92, wherein the friction enhancing portion 61 of the first surface 67 is large relative to a surface portion 65 on the other side of the blade 92 without the friction enhancing configuration. Any friction enhancing configuration formed on the second surface 69 of the second jaw member 68 having the blade recess 94 is preferably a mirror image of the friction enhancing configuration formed on the first surface 67.

In operation, the friction enhancing configuration 61 of the first surface 67 on one side of the blade 92 facilitates retention of one film tail from between the first surface 67 and the second surface 68 upon severing the roped film, whereas the lack of a friction enhancing configuration and the relatively small surface portion 65 facilitates release of the other film tail from between the first surface 67 and the second surface 68 on the other side of the blade 92 upon severing the roped film. Alternatively, the surface portion 65 on one side of the blade 92 may be stepped below the surface portion 61 on the other side of the blade 92 thereby forming a gap between first surface 67 and the second surface 69 on the stepped side of the blade 92 from which the film tail may be released more readily when the clamping member is in the closed or closing configuration. The resilient nature of the stretch film further facilitates separation and release of one of the film tails from the clamping member upon severing the film.

FIG. 2 also shows the base member 110 translatably coupled to a support arm 140 by pairs of guide members 150 coupled rotatably to the support arm 140 and translatably supporting opposing lateral sides 112 of the base member 110. An actuatable cylinder member 160 is coupled at one end 162 to the base member 110 and at another end 164 to the support arm 140, whereby the base member 110 is translatably extendable and retractable relative to the support arm 140 upon extension and retraction of a rod portion 166 of the cylinder member 160, which in the exemplary embodiment is a known pneumatically actuatable cylinder.

According to another aspect of the invention, the support arm 140 is pivotally coupled to a support member 170 at a pivot point 172. According to this aspect of the invention, a second actuatable cylinder member 180 is coupled at one end 182 to the support arm 140 and at another end 184 to the support member 170, whereby the support arm 140 is pivotally actuatable about the pivot point 172 to raise and lower the base member 110 relative to the support member 170 upon extension and retraction of a rod portion 186 of the cylinder member 180, which in the exemplary embodiment is also a known pneumatically actuatable cylinder.

The apparatus 100 generally composes part of a stretch film wrapping system and is located proximate a load wrapping station whereby the base member 110 is translatable laterally toward and away from a load positioned at the film wrapping station upon actuation of the cylinder member 160. The apparatus 100 may be located on a floor adjacent a lower portion of a stationary load as shown, or alternatively may be mounted invertedly adjacent an upper portion of the load. In rotating turn-table film wrapping systems, the apparatus 100 may be located on load platform or other movable member. And in ring film wrapping machines, the apparatus may be oriented so that the first and second arms 60 and 70 are pivotally extendable horizontally adjacent an end of the horizontally movable load. The base member 110 is also pivotally positionable upwardly toward and downwardly away from the load at the film wrapping station upon actuation of the second cylinder member 180. According to this aspect of the invention, the first and second arms 60 and 70 are pivotal upright toward the load when the base member 110 is pivoted upwardly and translated toward the load for capturing, retaining and securing the film as discussed above. During the film wrapping operation, and particularly during wrapping of the lower portions of the load, the arms 60, 70 are moved downwardly and the base member 110 is translatable laterally away and or pivoted downwardly away from the load to prevent obstruction therewith.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A method for securing a tail of stretch film wrapped about a load, the method comprising:

positioning a first arm toward the load, the first arm retaining an end portion of film;

wrapping at least one layer of film about the first arm positioned toward the load and the load so that at least a portion of the first arm is between the wrapped film and the load;

withdrawing at least a first portion of the first arm retaining the end portion of film from between the wrapped film and the load by simultaneously pivoting and shifting the first arm;

releasing the end portion of film retained by the first arm, whereby the end portion of film is at least partially positioned and secured between the wrapped film and the load.

2. The method of claim 1 further comprising withdrawing at least a first portion of the first arm retaining the end portion of film from between the wrapped film and the load along a relatively straight path.

3. The method of claim 1, the end portion of film is a leading end portion of the film wrapped about the load, the method further comprising:

positioning a second arm toward the load after wrapping film about the load;

wrapping at least one layer of film about the second arm positioned toward the load and the load so that at least a portion of the second arm is between the wrapped film and the load;

roping a trailing end portion of film after wrapping the load;

capturing and retaining the roped portion of film with the second arm positioned toward the load;

withdrawing the second arm retaining the roped portion of film from between the wrapped film and the load; and releasing the roped portion of film retained by the second arm, whereby the trailing end portion of film is at least partially positioned and secured between the wrapped film and the load.

4. The method of claim 3 further comprising capturing and retaining the roped portion of film with the first arm positioned toward the load, severing the roped portion of film between the first arm and the second arm, whereby the first arm retains an end portion of film.

5. The method of claim 3 further comprising retaining the leading end portion of film in a first clamping member on a first end portion of the first arm, and capturing and retaining the roped portion of film in a second clamping member on a second end portion of the second arm.

6. The method of claim 3 further comprising withdrawing at least a second portion of the second arm retaining the roped portion of film from between the wrapped film and the load along a relatively straight path.

7. The method of claim 3 further comprising withdrawing the second arm retaining the roped portion of film from between the wrapped film and the load by simultaneously pivoting and shifting the second arm.

8. An apparatus useable for securing a tail of stretch film wrapped about a load, the apparatus comprising:

a first arm pivotally coupled at a first base portion of the first arm to a base member;

a first clamping member at a first end portion of the first arm, the first clamping member having at least one movable first jaw member actuatable between an opened configuration and a closed configuration relative to a second jaw member of the first clamping member;

a second arm pivotally coupled at a second base portion of the second arm to the base member;

a second clamping member at a second end portion of the second arm, the second clamping member having at least one movable first jaw member actuatable between an opened configuration and a closed configuration relative to a second jaw member of the second clamping member;

the first arm and the second arm are pivotally positionable toward and away from the load.

9. The apparatus of claim 8, the movable first jaw member of the first clamping member is movable axially toward and away from a fixed second jaw member at the first end portion of the first arm, and the movable first jaw member of the second clamping member is movable axially toward and away from a fixed second jaw member at the second end portion of the second arm, whereby the film is capturable and retainable between the first jaw member and the second jaw member of the first clamping member in the closed configuration, and the film is capturable and retainable between the first jaw member and the second jaw member of the second clamping member in the closed configuration.

10. The apparatus of claim 9, the first clamping member including a film severing member between the movable first jaw member and the second jaw member, the film severing member severing film between the first jaw member and the second jaw member of the first clamping member in the closed configuration, whereby a first severed film portion is released from the first clamping member and a second severed film portion is retained in the first clamping member.

11. The apparatus of claim 8 further comprising a support member including a pivotal support arm, the base member translatably coupled to the pivotable support arm, whereby the base member is translatable laterally toward and away from the load, and the support arm and base member are pivotal toward and away from the load.

12. The apparatus of claim 8 further comprising a rotary arm rotatable above the load, the rotary arm having an outer end with a downright member for supporting a reciprocatable stretch film dispenser orbital about the load as the rotary arm rotates above the load, whereby the stretch film dispenser pays out film under tension as the dispenser orbits the load and reciprocates along the downright to wrap film about the load.

13. The apparatus of claim 8 further comprising a first rodless cylinder pivotally coupled to the first base portion of the first arm, and a first link pivotally coupled to the first arm and to the base member, the first rodless cylinder movable relative to the base member to pivot and laterally shift the first arm relative to the base member, and a second rodless cylinder pivotally coupled to the second base portion of the second arm, and a second link pivotally coupled to the second arm and to the base member, the second rodless cylinder movable relative to the base member to pivot and laterally shift the second arm relative to the base member.

14. The apparatus of claim 8 further comprising:

a first rodless cylinder movable back and forth relative to the base member, the first base portion of the first arm pivotally coupled to the first rodless cylinder;

a first cylinder disposed on the first rodless cylinder, the first cylinder having an actuatable arm pivotally coupled to the first base portion of the first arm, the first arm pivotal upwardly upon extension of the actuatable arm and the first arm pivotal downwardly upon retraction of the actuatable arms the first arm translatable by the first rodless cylinder and simultaneously pivotable by the first cylinder;

a second rodless cylinder movable back and forth relative to the base member, the second base portion of the second arm pivotally coupled to the second rodless cylinder; and a second cylinder disposed on the second rodless cylinder, the second cylinder having an actuatable arm pivotally coupled to the second base portion of the second arm, the second arm pivotal upwardly upon extension of the actuatable arm and the second arm pivotal downwardly upon retraction of the actuatable arm, the second arm translatable by the second rodless cylinder and simultaneously pivotable by the second cylinder.

15. The method of claim 1 further comprising pivoting and shifting the first arm in a plane substantially parallel to a side of the load.

16. A method for securing a tail of stretch film wrapped about a load, the method comprising:

positioning a second arm toward the load after wrapping film about the load;

wrapping at least one layer of film about the second arm positioned toward the load and the load so that at least a portion of the second arm is between the wrapped film and the load;

roping a trailing end portion of film after wrapping the load;

capturing and retaining the roped portion of film with the second arm positioned toward the load;

withdrawing the second arm retaining the roped portion of film from between the wrapped film and the load; and releasing the roped portion of film retained by the second arm, whereby the trailing end portion of film is at least partially positioned and secured between the wrapped film and the load.

17. The method of claim 16 further comprising capturing and retaining the roped portion of film with a first arm positioned toward the load, severing the roped portion of film between the first arm and the second arm, whereby the first arm retains a leading end portion of film for wrapping another load.

18. The method of claim 16 further comprising withdrawing at least a second portion of the second arm retaining the roped portion of film from between the wrapped film and the load along a relatively straight path by simultaneously pivoting and shifting the second arm.

19. The method of claim 18 further comprising pivoting and shifting the second arm in a plane substantially parallel to a side of the load.

20. The method of claim 16 further comprising retaining the leading end portion of film in a first clamping member on a first end portion of the first arm, and capturing and retaining the roped portion of film in a second clamping member on a second end portion of the second arm.

* * * * *